US008863901B1

(12) United States Patent
Kyle

(10) Patent No.: US 8,863,901 B1
(45) Date of Patent: Oct. 21, 2014

(54) PORTABLE HANGING TOOLBOX

(76) Inventor: James William Kyle, Twentynine Palms, CA (US)

( * ) Notice: Subject to any disclaimer, the term of this patent is extended or adjusted under 35 U.S.C. 154(b) by 2192 days.

(21) Appl. No.: 11/312,928

(22) Filed: Dec. 20, 2005

Related U.S. Application Data

(60) Provisional application No. 60/638,076, filed on Dec. 21, 2004.

(51) Int. Cl.
*E04G 1/30* (2006.01)

(52) U.S. Cl.
USPC ..... 182/129; 206/373

(58) Field of Classification Search
USPC ..... 182/120, 129; 206/372, 373; 312/244
See application file for complete search history.

(56) References Cited

U.S. PATENT DOCUMENTS

| | | | | | |
|---|---|---|---|---|---|
| 4,867,332 | A * | 9/1989 | Mains | 220/735 |
| D344,180 | S * | 2/1994 | Garcia | D12/416 |
| 5,437,502 | A * | 8/1995 | Warnick et al. | 312/244 |
| 5,505,302 | A * | 4/1996 | Ferley | 206/373 |
| 5,603,405 | A * | 2/1997 | Smith | 206/373 |
| 5,622,278 | A * | 4/1997 | Fries et al. | 220/480 |
| 5,704,496 | A * | 1/1998 | Latta | 211/70.6 |
| 6,138,827 | A * | 10/2000 | Marshall | 206/373 |
| 6,401,862 | B1 * | 6/2002 | Caron | 182/129 |
| 6,536,590 | B1 * | 3/2003 | Godshaw et al. | 206/373 |
| 7,275,641 | B1 * | 10/2007 | Purnell | 206/373 |
| 2002/0070136 | A1 * | 6/2002 | Hedges | 206/373 |
| 2004/0159578 | A1 * | 8/2004 | Lieffring et al. | 206/557 |

* cited by examiner

*Primary Examiner* — James O Hansen
(74) *Attorney, Agent, or Firm* — Patula & Associates, P.C.

(57) ABSTRACT

A portable tool box includes an integrated hanger for engagement with a ladder rung on a ladder. The tool box is quickly and easily placed on a ladder allowing a user to quickly and safely store and access multiple tools while on the ladder.

18 Claims, 8 Drawing Sheets

PORTABLE HANGING TOOLBOX

This application claims priority to U.S. Provisional Patent Application entitled "Kyle Ladder-Mate" filed Dec. 21, 2004 and assigned U.S. Application Ser. No. 60/638,076, the entire disclosure of which is herein incorporated by reference.

The present disclosure relates generally to storage devices such as a tool box. In particular, the present disclosure relates to a tool box adapted to be hung from a structure such as a ladder. Specifically, the present disclosure relates to a portable tool box with an integrated hanger for engagement with a ladder rung on a ladder.

BACKGROUND OF THE INVENTION

Workers of all types, such as painters, electricians, carpenters, do-it-yourselfers, etc., frequently need to use a ladder to reach elevated work areas. Working on a ladder is often difficult, especially when multiple tools are needed for the work project at hand. Typically, the necessary tools either must be balanced precariously on the ladder, or left on the ground (or both). In the former situation, the worker risks the tools falling from the ladder and damaging the surface of impact, or the tools themselves. In the latter situation, the worker either must constantly climb up and down the ladder to swap tools, or have a second worker hand the tools back and forth, resulting in inefficiency.

Accordingly, there is a need by workers to be able to easily, quickly, securely and portably store and readily access multiple tools on a ladder or other similar elevated structure. The present invention fulfills such a need, and provides numerous other benefits and advantages.

BRIEF SUMMARY OF THE INVENTION

The present disclosure relates to a portable tool box which can be positioned on a ladder, allowing tools to be securely stored and easily accessed while on the ladder. An integrated hanger is adapted to engage a rung of the ladder, while side portions of the tool box rest on the legs of the ladder.

The tool box preferably comprises an integral bottom, back and hanger portion, a front box portion, and two side box portions. The tool box also preferably includes a handle, a hammer loop, and a removable accessory tray.

Accordingly, it is the principal object of the present disclosure to provide a storage device, such as a tool box.

It is a further object of the present disclosure to provide a portable storage device, such as a tool box, which is quickly and easily mounted to a structure, such as a ladder, and which allows tools or other items to be safely stored and easily accessed while on the structure.

It is also an object of the present disclosure to provide a portable tool box having an integrated hanger device which allows the tool box to be positioned on a structure, such as a ladder.

It is another object of the present disclosure to provide a portable tool box which can securely mount to ladders of all shapes and sizes, at any desired location along the ladder.

It is an additional object of the present disclosure to provide a tool box which is fast and easy to mount to a structure such as a ladder, and which is sturdy and strong.

Numerous other advantages and features of the disclosure will become readily apparent from the following detailed description, from the claims and from the accompanying drawings in which like numerals are employed to designate like parts throughout the same.

BRIEF DESCRIPTION OF THE DRAWINGS

A fuller understanding of the foregoing may be had by reference to the accompanying drawings wherein.

DETAILED DESCRIPTION OF THE DISCLOSED EMBODIMENT

Figure 1:
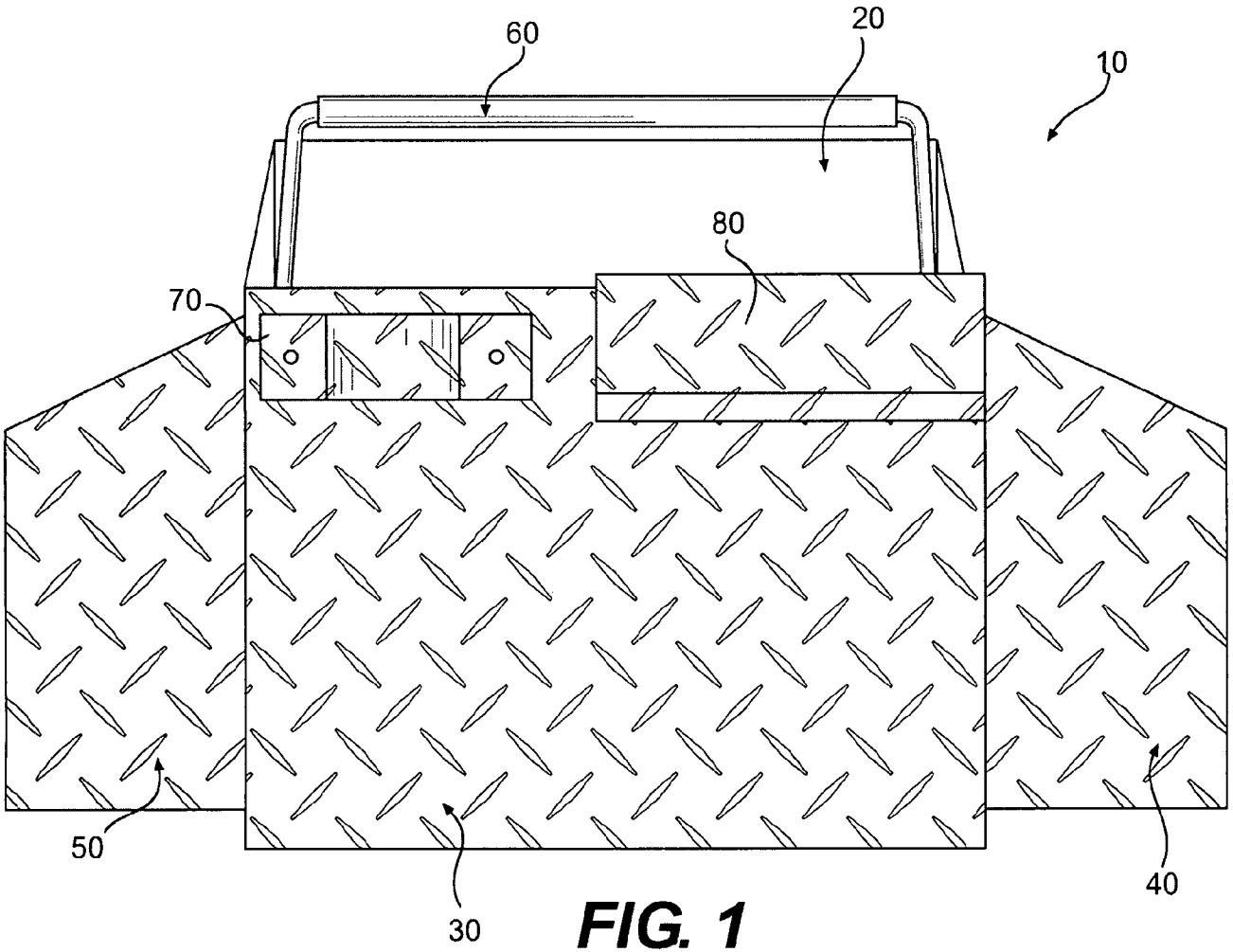
FIG. 1 is a front view illustrating a preferred embodiment of the storage device or tool box of the present disclosure.

While the invention is susceptible of embodiment in many different forms, there is shown in the drawings and will be described herein in detail one or more embodiments of the present disclosure. It should be understood, however, that the present disclosure is to be considered an exemplification of the principles of the invention, and the embodiment(s) illustrated is/are not intended to limit the spirit and scope of the invention and/or the claims herein.

FIG. 1 is a front view illustrating a preferred embodiment of the storage device or tool box 10 of the present disclosure. As can be seen, the tool box 10 preferably comprises an integral bottom, back and hanger portion 20, a front box portion 30, and two side box portions 40 and 50. As can further be seen, the tool box also preferably includes a handle 60, a hammer loop 70, and a removable accessory tray 80. Each of these components can be seen in more detail in FIG. 2.

Figure 2:
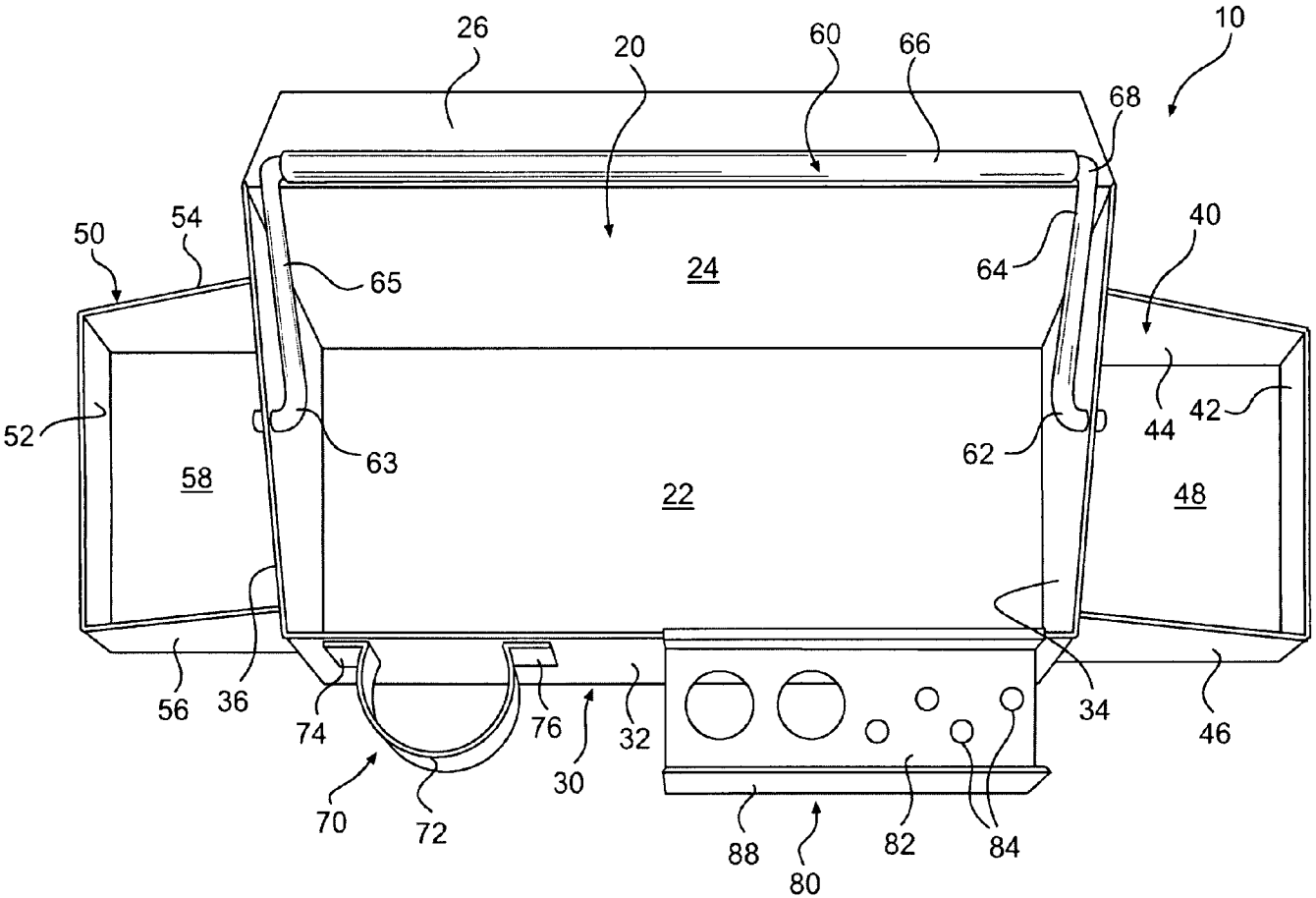
FIG. 2 is a top perspective view illustrating a preferred embodiment of the storage device or tool box of the present disclosure.

FIG. 2 is a top perspective view illustrating a preferred embodiment of the storage device or tool box 10 of the present disclosure. As can be seen, integral bottom, back and hanger portion 20 includes a bottom portion 22, a back portion 24 and a hanger portion 26. Suitably connected to the integral bottom, back and hanger portion 20 is front box portion 30. Front box portion 30 generally comprises a front wall 32 and two side walls 34 and 36, defining a box along with bottom portion 22 and back portion 24. Back portion 24 and/or bottom portion 22 preferably include one or more flanges for suitable connection with side walls 34 and 36 in any suitable manner such as with rivets, welds or in any other suitable manner.

Suitably connected to the side walls 34 and 36 of the front box portion 30 are side box portions 40 and 50, respectively. Side box portion 40 generally comprises a front wall 42, two side walls 44, 46, and a bottom 48. Side box portion 50 generally comprise a front wall 52, two side walls 54, 56, and a bottom 58. Side walls 44, 46 and 54, 56 and/or bottoms 48 and 58 preferably include one or more flanges for suitable connection with side walls 34, 36, respectively, in any suitable manner such as with rivets, welds or in any other suitable manner.

Handle 60 is also suitable attached to the side walls 34, 36 of the front box portion 30, and generally spans the length there between. Handle 60 comprises stub out portions 62, 63, extension portions 64, 65, and handle portion 66. Preferably, handle portion 66 has a handle grip 68 thereon. Stub out portions 62, 63 are suitably attached to side walls 34, 36, respectively, in such a manner as to allow rotation of the handle 60 relative to side walls 34, 36.

Suitably connected to the front wall 32 of the front box portion 30 are hammer loop 70 and removable accessory tray 80. Hammer loop 70 generally takes the form of a semi-circular or semi-tubular member 72 having flanges 74 and 76 extending there from. Flanges 72 and 74 are suitably attached to front wall 32 in any suitable manner, such as by rivets, welds or in any other suitable manner.

Removable access tray 80 generally comprises a platform section 82 having a plurality of holes 84 therein. A double wall portion 86, defining a slot 87, extends upward from one side of the platform section 82. A lip portion 88 extends upward from an opposite side of the platform section 82. The removable accessory tray 80 is supported on the front wall 32 when double wall portion 86 is slid onto the front wall 32, which is received in the slot 87, as best seen in FIG. 3.

Figure 3:
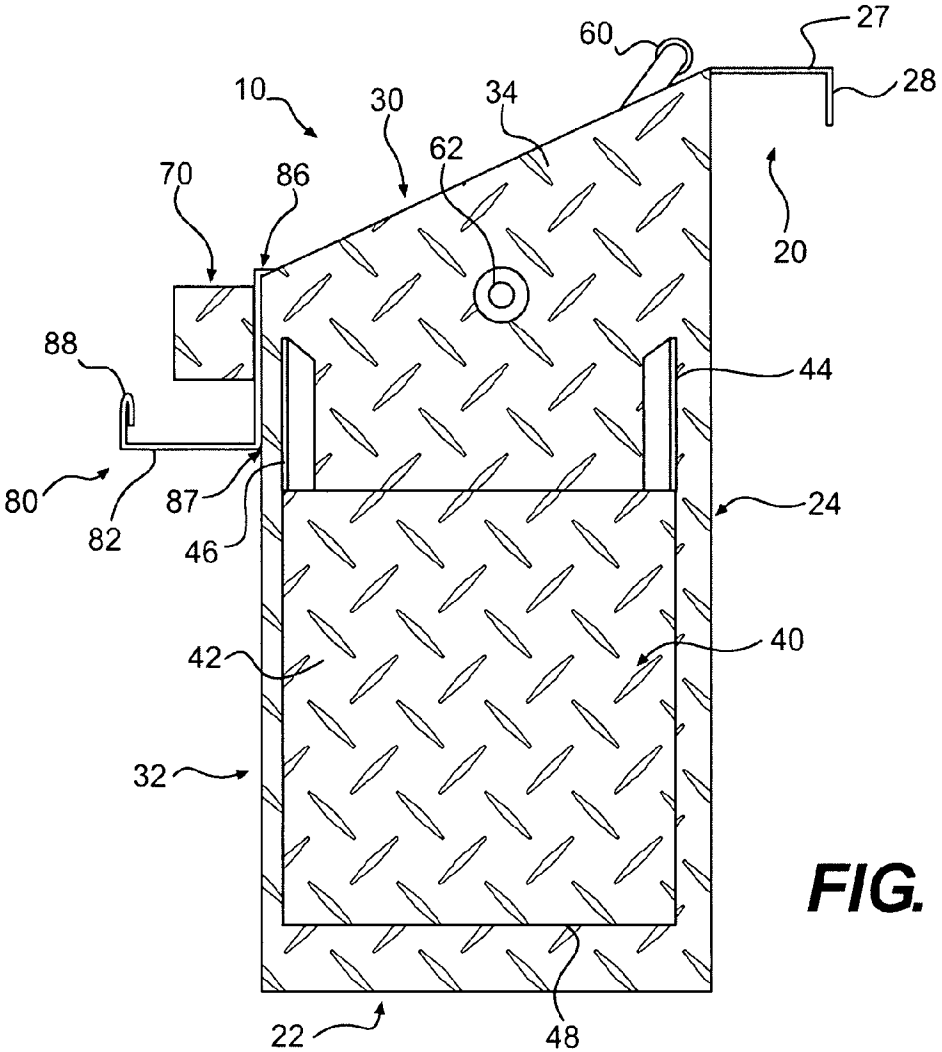
FIG. 3 is a side view illustrating a preferred embodiment of the storage device or tool box of the present disclosure.

FIG. 3 is a side view illustrating a preferred embodiment of the storage device or tool box 10 of the present disclosure. As can be seen, front box portion 30 suitably connects to the integral bottom, back and hanger portion 20. Hanger portion 26 of integral bottom, back and hanger portion 20 is shown extending from back portion 24, and comprises extension portion 27 and flange 28.

Side wall 34 of front box portion 30 can be seen with handle 60 suitably attached to the side wall 34 via stub out 62. Stub out portions 62, 63 are preferably attached to side walls 34, 36, respectively, using a washer and a cotter pin.

Side box portion 40 can be seen suitably attached to side wall 34. Side box portion 40 generally comprises a front wall 42, two side walls 44, 46, and a bottom 48.

Hammer loop 70 can be seen suitably connected to the front wall 32 of the front box portion 30.

Removable accessory tray 80 can also be seen removably supported on the front wall 32. Removable access tray 80 generally comprises a platform section 82, double wall portion 86, defining a slot 87 for receiving front wall 32 therein, and lip portion 88.

Figure 4:
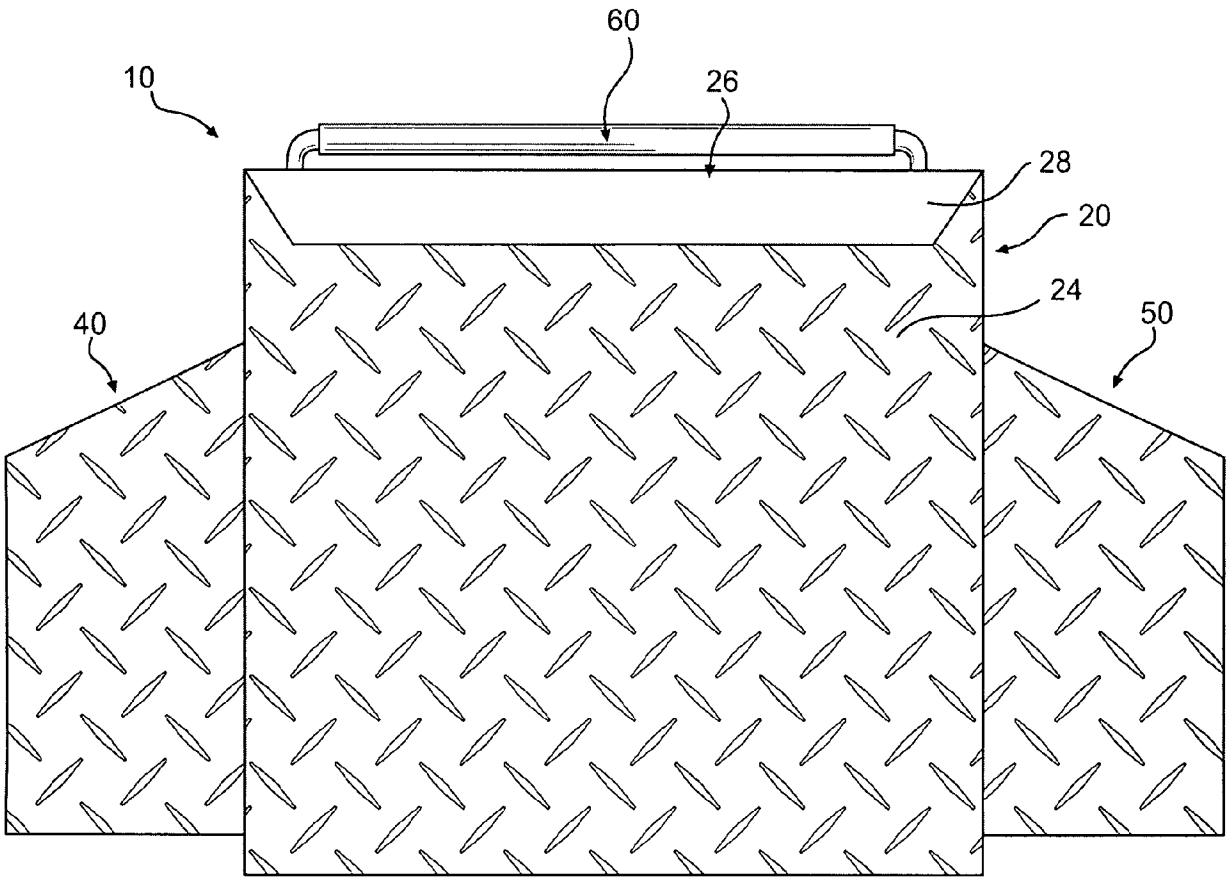
FIG. 4 is a back view illustrating a preferred embodiment of the storage device or tool box of the present disclosure.

FIG. 4 is a back view illustrating a preferred embodiment of the storage device or tool box 10 of the present disclosure. As can be seen, integral bottom, back and hanger portion 20 has hanger portion 26 along the top edge of back portion 24. Hanger portion 26 includes flange 28. Shown extending from the side walls 34 and 36 of the front box portion 30 are side box portions 40 and 50, respectively. Handle 60 can also be seen extending above hanger portion 26.

Figure 5:
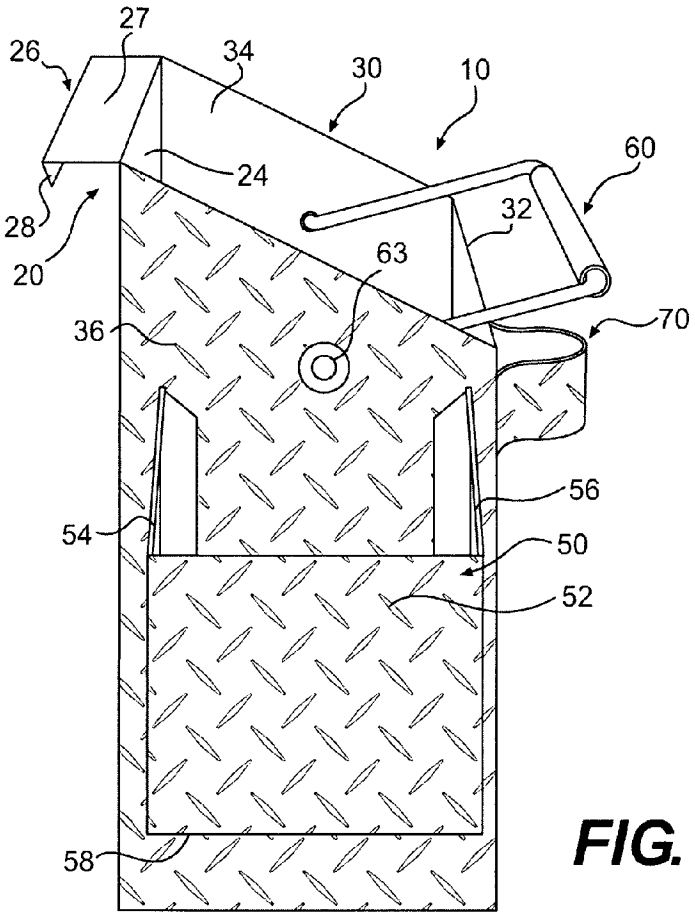
FIG. 5 is a side perspective view illustrating a preferred embodiment of the storage device or tool box of the present disclosure.

FIG. 5 is a side perspective view, opposite that of FIG. 3, illustrating a preferred embodiment of the storage device or tool box 10 of the present disclosure. In FIG. 5, the removable accessory tray 80 has been removed.

As can be seen in FIG. 5, front box portion 30 suitably connects to the integral bottom, back and hanger portion 20. Hanger portion 26 of integral bottom, back and hanger portion 20 is shown extending from back portion 24, and comprises extension portion 27 and flange 28. Side wall 36 of front box portion 30 can be seen with handle 60 suitably attached to the side wall 36 via stub out 63. Side box portion 50, comprising front wall 52, two side walls 54, 56, and bottom 58, can be seen suitably attached to side wall 36. Hammer loop 70 can be seen suitably connected to the front wall 32 of the front box portion 30.

Figure 6:
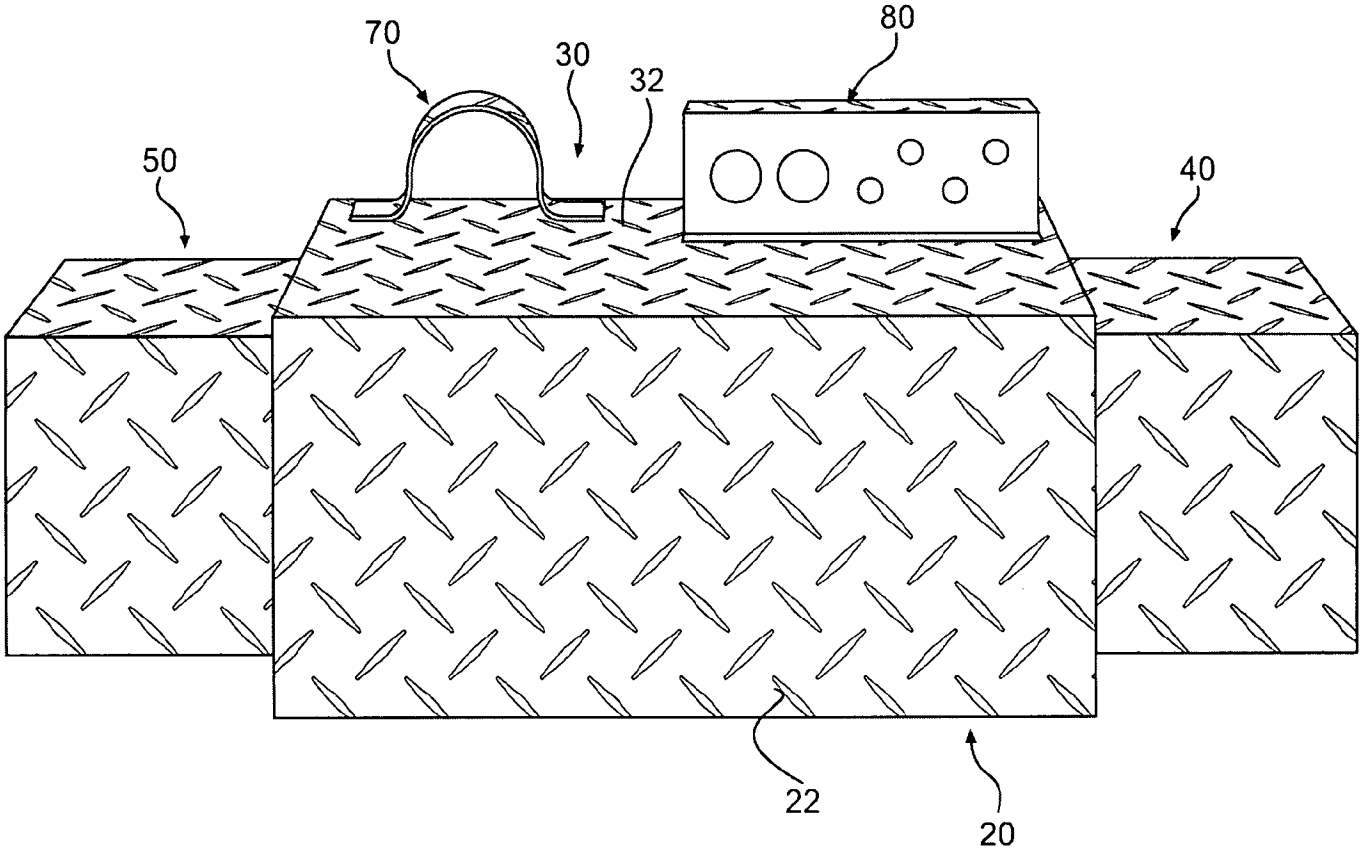
FIG. 6 is a bottom perspective view illustrating a preferred embodiment of the storage device or tool box of the present disclosure.

FIG. 6 is a bottom perspective view illustrating a preferred embodiment of the storage device or tool box 10 of the present disclosure. As can be seen bottom portion 22 of integral bottom, back and hanger portion 20 meets front wall 32 of front box portion 30. Side box portions 40 and 50 extend from front box portion 30. Hammer loop 70 and removable accessory tray 80 are attached to front wall 32.

Figure 7:
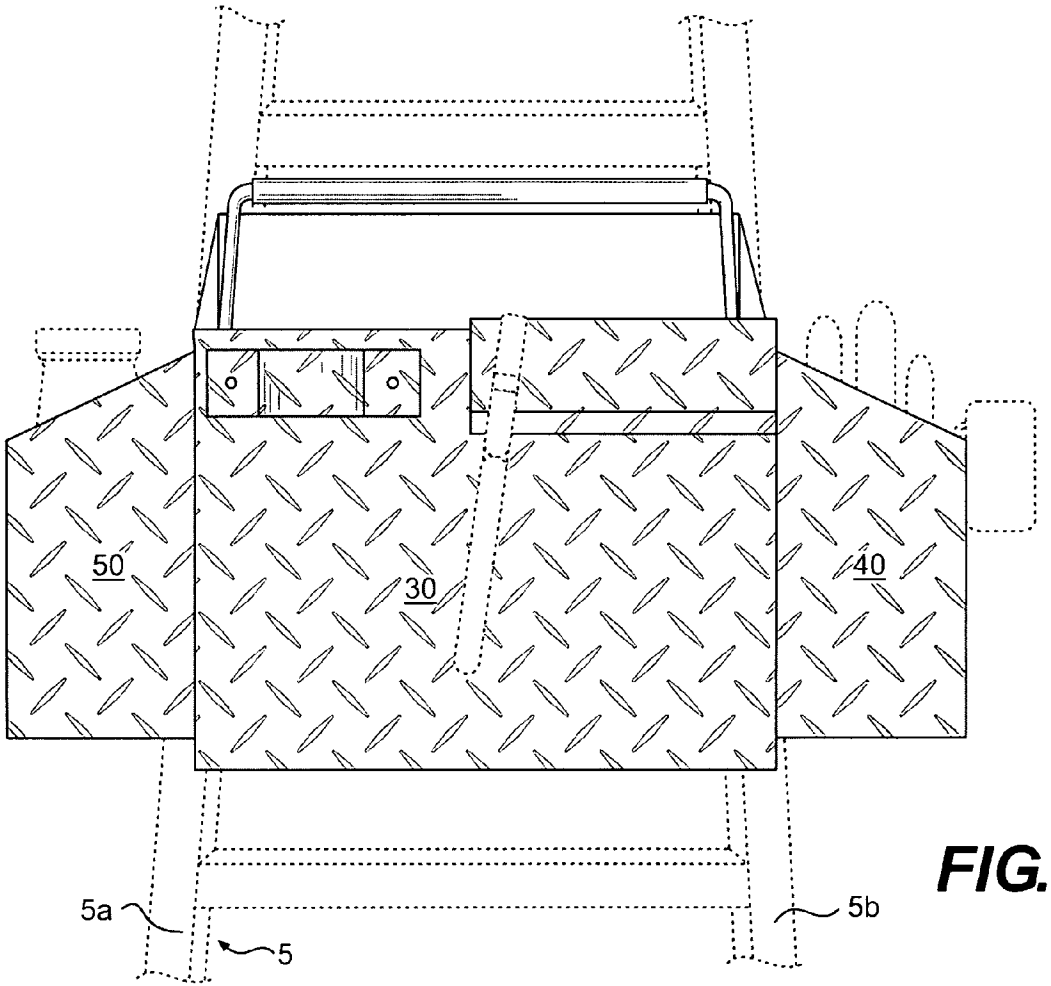
FIG. 7 is a front view of a preferred embodiment of the storage device or tool box of the present disclosure mounted on a ladder.

Referring now to FIG. 7, a front view of a preferred embodiment of the storage device or tool box 10 of the present disclosure mounted on a ladder 5 is shown. A plurality of tools and other items are shown securely stored by tool box 10.

It should be understood that ladder 5 has one or more cross members (hidden behind tool box 10) to which hanger portion 26 is placed over. Thus, tool box 10 hangs from the cross member over which hanger portion 26 is placed.

Further, tool box 10 is preferably sized such that when hanger portion 26 is placed over a cross member of ladder 5, side box portions 40 and 50 contact and rest upon legs 5*b* and 5*a*, respectively, of ladder 5, with the weight of the tool box exerting a force on the legs 5*a* and 5*b*. In this manner, the tool box 10 is securely mounted on the ladder when in use, yet remains quick and easy to remove there from simply by lifting the handle to remove hanger portion 26 from the cross member of the ladder.

Figure 8:
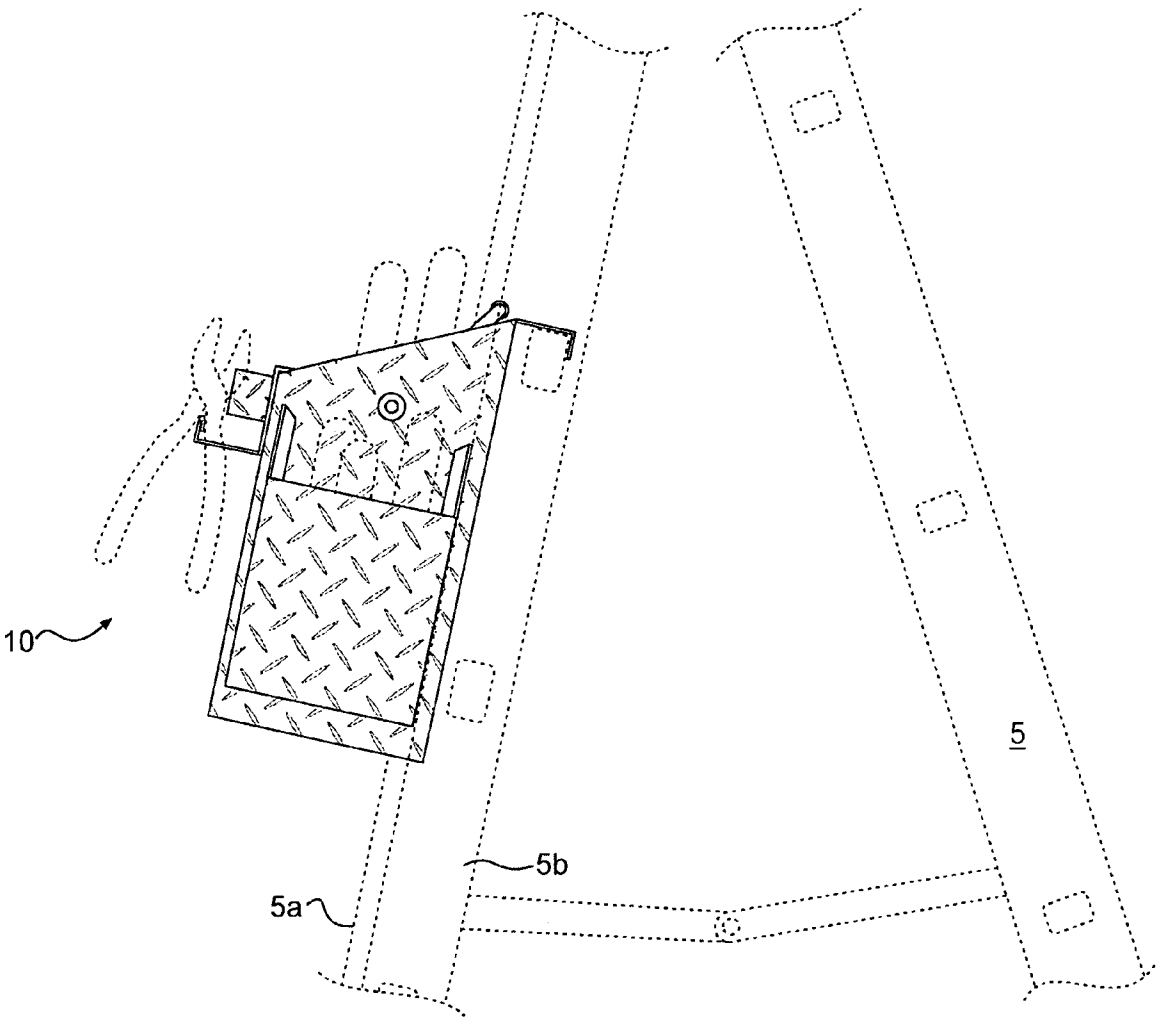
FIG. 8 is a side view of a preferred embodiment of the storage device or tool box of the present disclosure mounted on a ladder.

FIG. 8 is a side view of a preferred embodiment of the storage device or tool box 10 of the present disclosure mounted on a ladder 5. As can be seen, side box portion 40 rests against leg 5*b* of ladder 5 as described above. In this configuration, the front box 30 (including back wall 24) extends approximately a half inch into the ladder, between legs 5*a* and 5*b* (as should be apparent from FIG. 3. Such a configuration provides added stability for the tool box. Accordingly, it should be readily apparent that the tools stored by the tool box 10 are securely stored, yet remain quickly and easily accessible by a worker standing on the ladder 5.

The one-piece construction of the bottom, back and hanger portion 20 gives the tool box great strength. It should be understood however that the bottom portion 22, back portion 24 and hanger portion 26 could be separate pieces suitably attached to each other and/or to other components of the tool box.

The preferred materials used to construct the tool box are as follows. The bottom, back and hanger portion 20 is constructed from 18 gage sheet steel. The front box portion 30 and the side box portions 40, 50 are constructed from 16 gage polished diamond plate aluminum. The handle 60 is constructed from a 5/16 inch stainless steel rod. Grip 68 is constructed from PVC webbed reinforced hose cut for the center of the handle. The hammer loop 70 and the removable access tray 80 are constructed from 16 gage polished aluminum diamond plate.

The preferred dimensions of the components of the tool box are as follows. The bottom portion 22 is an approximately 6×12 inch plate. The back portion 24 is an approximately 12×12 inch plate. The extension portion 27 of hanger portion 26 is an approximately 1¼×12 inch plate. The flange portion 28 of hanger portion 26 is an approximately 1¼×12 inch plate. The front and sides of the bottom portion 22 and the sides of the back portion 24 preferably have ½ inch tabs extending approximately 90 degrees there from providing an attachment surface for the front box portion 30.

The front wall 32 is an approximately 12×12 inch plate. The two side walls 34 and 36 are approximately six inch wide plates with their height extending from nine inches in the front to twelve inches in the back. The handle hole in each of the side walls 34, 36 is approximately ⅜ inch in diameter and is placed approximately nine inches up from the bottom and 3½ inches in from the front of the side walls 34, 36.

The front wall 42 is an approximately 5×6 inch plate. The two side walls 44, 46 are approximately four inch wide plates with their height extending from six inches in the front to eight inches in the back. The bottom 48 is an approximately 4×5 inch plate. The bottom portion 48 and the side walls 44, 46 preferably have inch tabs extending approximately 90 degrees there from providing an attachment surface for the side box portions 40 and 50.

The handle stub outs 62, 63 are approximately one inch long and have a 3/16 inch drilled hole for receiving a ⅛ inch steel cotter pin. The extension portions 64, 65 are approximately 4½ inches in length. The handle portion 66 is approximately 11¼ inches in length. The handle grip 68 is approximately 10¾ inches long.

The semi-tubular member 72 is approximately one and ⅜ inches wide and having an approximately two inch radius. The flanges 74, 76 extend approximately one inch.

The platform section 82 is an approximately 2×6 inch plate. The holes 84 preferably are two centered one inch diameter punched holes from left to center, and four staggered ⅜ inch holes from center to right. The double wall portion 86 is two approximately 3×6 inch plates connected at the top with a slot there between sized to receive the front wall 32. The lip portion 88 measures approximately ½×6. A ½×6 inch hem is preferably provided on the lip portion 88 and the outside wall of the double wall portion 86.

It is to be understood that the embodiment(s) herein described is/are merely illustrative of the principles of the present invention. Various modifications may be made by those skilled in the art without departing from the spirit or scope of the claims which follow.

For example, all of the components of the present disclosure can have various lengths and widths, as desired, and each could take any suitable shape or form, so long as they accomplish the purposes described herein. For example, it is foreseen that the platform of the removable accessory tray could be circular and be sized to support a can of paint.

Further, all of the components of the present disclosure can be made from any suitable material, such as any suitable metal, plastic or rubber, sufficient to serve the intended purpose of each part. Further each part can be coated or suitable treated to prevent corrosion, or for decorative purposes. Additionally, any or all of the separate components described herein could be made to be integral with any of the other components. Similarly, the entire tool box, except for the handle if pivoting is desired, could be one integral piece.

It is also foreseen that each component can be suitably connected to the other components in any configuration and with any suitable fastening devices or methods. For example, instead of side box portions 40 and 50, the front box portion 30 could be one big box, and could have dividers therein, as desired. Further, side box portions 40 and/or 50 could be circular or tubular to hold a can of paint, etc.

Still further, the hammer loop and the removable accessory tray could attach to any wall of the tool box, and a plurality of each could be used, etc. Additionally, the hanger portion could take any suitably form or shape, such as one or more hooks, straps or other fastening devices which would allow the tool box to be connected to a cross member of any other portion of the ladder. Other variations of this nature are contemplated.

What is claimed is:

1. A tool box, comprising:

a storage portion defined by a bottom portion, a back portion, a front portion, a first side portion and a second side portion;

a removable accessory tray adapted to selectively slide onto the front portion of the storage portion;

a first side box attached to the first side portion of the storage portion;

a second side box attached to the second side portion of the storage portion;

a hanger portion attached to the back portion;

wherein the hanger portion is adapted to engage a horizontal cross-member of a ladder to support the storage portion on the ladder; and wherein the ladder has leg members which define an angle to a surface, and wherein the first side box and the second side box are adapted to abut respective leg members of the ladder such that the tool box conforms to the angle of the leg members.

2. The tool box of claim 1, further comprising a hammer loop attached to the front portion of the storage portion.

3. The tool box of claim 1, further comprising a handle attached to the first side portion and the second side portion of the storage portion and extending across the storage portion.

4. The tool box of claim 1, wherein the hanger portion is integral with the back portion and comprise a one-piece article.

5. The tool box of claim 1, wherein the hanger portion, the back portion and the bottom portion are integral and comprise a one-piece article.

6. The tool box of claim 5, wherein the front portion, the first side portion and the second side portion are integral and comprise a one-piece article which is suitably attached to the back portion and/or the bottom portion.

7. The tool box of claim 1, wherein the hanger portion is generally hook-shaped, wherein the back portion defines a length, and wherein the hanger portion extends substantially along the length of the back portion.

8. The tool box of claim 1, wherein the first side box and the second side box are rigid and inflexible, or metal.

9. The tool box of claim 1, wherein the first side box and the second side box are offset from the back portion, wherein the back portion and hanger portion pass between the leg members and extend into the ladder.

10. A hanging tool box for a ladder having legs and at least one cross-member, the hanging tool box comprising:

an integral bottom, back and hanger portion;

a front box portion defined by a front wall, a first side wall and a second side wall, wherein the front box portion is suitably connected to the integral bottom, back and hanger portion to form the hanging tool box;

a first side box attached to the first side wall of the front box portion and a second side box attached to the second side wall of the front box portion, wherein the first side box and the second side box are adapted to abut respective legs of the ladder;

wherein the hanger of the integral bottom, back and hanger portion is generally hook-shaped and is adapted to engage the at least one cross-member of the ladder to support the tool box on the ladder such that the tool box conforms to the angle of the legs of the ladder.

11. The hanging tool box of claim 10, further comprising a removable accessory tray adapted to selectively slide onto the front box portion of the hanging tool box.

12. The hanging tool box of claim 10, further comprising a handle attached to the first side wall and the second side wall of the front box portion and extending across the front box portion.

13. The hanging tool box of claim 10, wherein the hanger of the integral bottom, back and hanger portion extends substantially across a length of the back of the integral bottom, back and hanger portion.

14. The hanging tool box of claim 10, wherein the first side box and the second side box are rigid and inflexible, or metal.

15. The hanging tool box of claim 10, wherein the first side box and the second side box are offset from the back portion, wherein the back portion and hanger portion are adapted to pass between the legs of the ladder and extend into the ladder.

16. A hanging tool box for a ladder having legs and at least one cross-member, comprising in combination:

a main storage box defined by a bottom portion, a back wall, a front wall, a first side wall and a second side wall;

a first side box attached to the first side wall of the main storage box;

a second side box attached to the second side wall of the main storage box;

a hanger portion attached to and extending substantially along the length of the back wall;

wherein the hanger portion is adapted to engage the at least one cross-member of the ladder to support the hanging tool box on the ladder, and wherein the first side box and the second side box abut the respective legs of the ladder when the hanger portion engages the at least one cross-member of the ladder, such that the hanging tool box conforms to an angle of the legs of the ladder.

17. The hanging tool box for a ladder of claim 16, wherein the first side box and the second side box are rigid and inflexible, or metal.

18. The hanging tool box for a ladder of claim 16, wherein the first side box and the second side box are offset from the back wall, wherein the back wall and hanger portion pass between the legs of the ladder and extend into the ladder.

* * * * *